United States Patent [19]

Lewin

[11] Patent Number: 4,575,788

[45] Date of Patent: Mar. 11, 1986

[54] SEGMENTED LUMINAIRE

[75] Inventor: Ian Lewin, Scottsdale, Ariz.

[73] Assignee: QL, Inc., Northbrook, Ill.

[21] Appl. No.: 605,428

[22] Filed: Apr. 30, 1984

[51] Int. Cl.[4] ..... F21V 7/12

[52] U.S. Cl. ..... 362/346; 362/297; 362/347

[58] Field of Search ..... 362/217, 296, 297, 341, 362/346, 347, 350

[56] References Cited

U.S. PATENT DOCUMENTS 3,213,271 10/1965 Tolbert .
3,628,852 12/1971 Snaper et al. .
4,164,012 8/1979 Gulliksen .
4,207,607 6/1980 Gulliksen .
4,229,782 10/1980 Ruud et al. ..... 362/297
4,242,727 12/1980 deVos et al. ..... 362/347 X
4,261,029 4/1981 Mousset .
4,338,655 7/1982 Gulliksen et al. .

*Primary Examiner*—Tony M. Argenbright
*Attorney, Agent, or Firm*—LaValle D. Ptak

[57] ABSTRACT

A luminaire for use with HID lightbulbs includes a housing having four primary identical compound curve reflector sections oriented with two sections on each side of the lamp to cause major projections of the light emanating from the luminaire diagonally of the longitudinal axis of the lamp in a horizontal plane to create a square or rectangular distribution of light on the surface to be illuminated. Auxiliary reflector sections are placed at the ends of the light bulb and interconnect the main reflector sections to create an increase in the light projected along the lamp axis to compensate for the reduction in inherent lamp intensity along its axis.

14 Claims, 7 Drawing Figures

SEGMENTED LUMINAIRE

BACKGROUND OF THE INVENTION

In the design of lighting systems of the type used for illuminating roadways, parking lights, warehouses and the like, a primary goal is to obtain uniform illumination of the area covered by each individual light fixture in the system to avoid bright spots and dark spots on the surface being illuminated. Furthermore, it is desirable to minimize, as much as possible, the total amount of energy consumed by a lighting system, since energy costs in recent years have skyrocketed. Because of the low energy consumption which they require, high intensity discharge (HID) lamps have found widespread acceptance in such commercial applications. HID lamps, however, produce relatively weak light patterns in planes including the axis of the lamp, and produce strong light patterns in planes perpendicular to the lamp axis. This results in a good inherent light distribution below and on opposite sides of the lamp, but weak distribution of light off the ends of the lamp. For maximizing light output, however, these lamps typically are mounted in planes horizontal to the plane of the surface to be illuminated.

When laying out a pattern of luminaires to illuminate an area, such as a parking lot or the like, the lighting engineer has a limited number of choices of light distributions which are effected by employing pole layouts in various patterns. For example, if the pole layout is in the form of squares, it is desirable to employ luminaires, each one of which produces a square pattern of light. In this way, the square patterns of light may be nested against each other to give complete coverage of the area to be lighted. In other situations where the layout of the light poles may be on a rectangular pattern, a rectangular pattern of light from the individual luminaires would be beneficial. Whenever a luminaire produces a pattern of light which does not fit the exact area to be lighted, a problem is created with spilled light, due to lighting unwanted areas, with consequent power wasteage, or portions of the area to be lighted may have inadequate illumination.

In the past, various attempts have been made to adjust the patterns of the light emanating from a luminaire by the provision of segmented adjustable reflector sections in the luminaire. A typical luminaire of this type used with an incandescent lamp, however, and not subject to the unique light dispersion characteristics of HID lamps, is disclosed in the patent to Tolbert, U.S. Pat. No, 3,213,271. This patent is directed to a luminaire used for lighting residential streets and includes a pair of compound curved reflector segments mounted on opposite sides of the bulb. These reflector segments each are individually adjustable by sliding them in grooves to effect both vertical orientation or tilting and horizontal positioning about the bulb. Thus, reflected light may be shifted within a limited range upwardly or downwardly to direct the beam of light in appropriate directions on a hilly road and also, to adjust the beam laterally to maximize the direction of the beam on a curve in the road when the light fixture is located at such a curve. The reflector segments of Tolbert, however, do not compensate for a reduction in inherent lamp intensity in one or more directions, since this problem does not exist with the incandescent bulb used in the Tolbert fixture and mounted as disclosed in the Tolbert patent.

Another luminaire with adjustable reflectors in it for the purpose of providing an asymmetrical illumination of the region beneath the fixture is disclosed in the patent to Mousset, U.S. Pat. No. 4,261,029. The fixture of the Mousset patent mounts a lamp in an eccentric position within the fixture and locates adjustable reflector elements on opposite sides of the light-producing planes of the lamp to direct the light from the fixture off to one side of the region located beneath the fixture. There is no attempt to compensate for reduced illumination from the lamp in any planes where such reduced illumination, if any, takes place.

Other attempts to provide varying illumination in the form of adjustable luminaires for changing the light emitting therefrom from a floodlight configuration to a spotlight configuration and vice-versa are disclosed in the patents to Gulliksen, U.S. Pat. No. 4,338,655, and Snaper, U.S. Pat. No. 3,628,852. The Gulliksen discloses a main reflector in conjunction with a number of fan-type interengaging reflector sections to accomplish this purpose. The light pattern produced, however, in all of the configurations of the reflector elements in the Gulliksen device is a circular pattern. The Snaper patent also is a spot/flood reflector which uses a deformable material for the reflector to vary the curvature of the reflector behind the bulb and to widen or narrow the open end of the reflector. Once again, a circular light pattern is produced in all of the different configurations of the reflector element of the Snaper luminaire.

It is desirable to provide a luminaire which is capable of producing generally rectangular or square patterns of light of uniform intensity in the area beneath the luminaire which, at the same time, utilizes HID lamps or the like for the inherent desirable characteristics associated with such lamps. Further, it is desirable to provide such a luminaire which compensates for the inherent reduction in lamp intensity along the direction of the axis of an HID lamp.

SUMMARY OF THE INVENTION

Accordingly, it is an object of this invention to provide an improved luminaire.

It is another object of this invention to provide an improved luminaire which compensates for variations in lamp intensity in different directions from an HID lamp.

It is a further object of this invention to provide an improved luminaire for producing uniform rectangular light patterns from an HID lamp source.

In accordance with a preferred embodiment of this invention, a luminaire has four compound curved reflectors disposed symmetrically about an elongated light source for building up the diagonal distribution of light to produce generally square or rectangular light patterns.

DETAILED DESCRIPTION

Reference now should be made to the drawings in which the same or similar components have the same reference numbers throughout the different figures.

Figure 1:
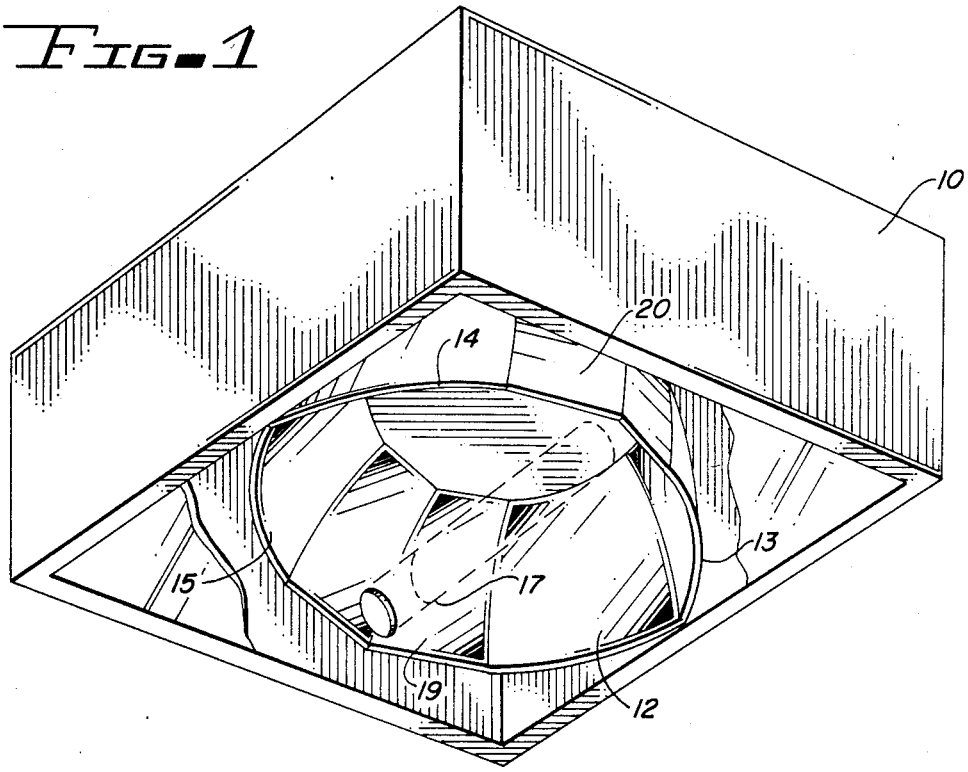
FIG. 1 is a bottom perspective view of a preferred embodiment of the invention.

Reference first should be made to FIG. 1, which is a bottom perspective view of a preferred embodiment of a luminaire made in accordance with this invention. The luminaire is mounted in a housing 10 which typically is mounted on a pole (not shown) in a parking lot or along a roadway and the like. The luminaire has four main compound-curved reflector sections 12, 13, 14 and 15 in it. These reflector sections 12 through 15 are symmetrically mounted in pairs 12/13 and 14/15 on opposite sides of an HID bulb 17.

Two additional reflector sections 19 and 20 are mounted at the opposite ends of the bulb 17, and each of these additional reflector sections are made with a fold or crease at their mid-points to cause each of them to be in the form of a dual section unit. The reflector section 20 joins ends of the main reflector sections 13 and 14 and the reflector section 19 joins ends of the main reflector sections 12 and 15. This is readily seen from an examination of FIGS. 1 and 2.

The other ends of the reflector sections 12 and 13 are joined together at a common line which lies in a plane perpendicular to the longitudinal axis of the HID lamp 17. Similarly, the other ends of the sections 14 and 15 are joined together on a line which also lies in this plane, perpendicular to the axis of the HID lamp 17. The plane bisects the longitudinal dimension of the HID lamp, and lies along the dimension "A" illustrated in FIG. 2. Similarly, the creases in the sections 19 and 20 are aligned with the longitudinal axis of the HID bulb 17, and lie along the dimension line "B" shown in FIG. 2. For the purpose of producing a uniformly illuminated square pattern from the HID lamp 17 shown in FIGS. 1 and 2, the dimension "A" is longer than the dimension "B", and the differences between these dimensions initially are selected to produce the desired pattern.

As is readily apparent, the reflector system consists of only six components. The four main reflector stations 12, 13, 14 and 15 all are identical to one another, and are displaced diagonally in the housing 10 in a horizontal plane. These reflector segments receive light from the lamp 17 which is then projected in mainly diagonal directions, as shown by the typical light rays illustrated in FIG. 2 as being reflected from the reflector segment 14. Comparable patterns of diagonal reflection take place from each of the four segments 12, 13, 14 and 15. By directing the light from the HID bulb 17 along these diagonals, a square distribution of light or a rectangular distribution of light is obtainable from an HID bulb 17 oriented in a plane parallel to the plane of the surface to be illuminated.

Figure 2:
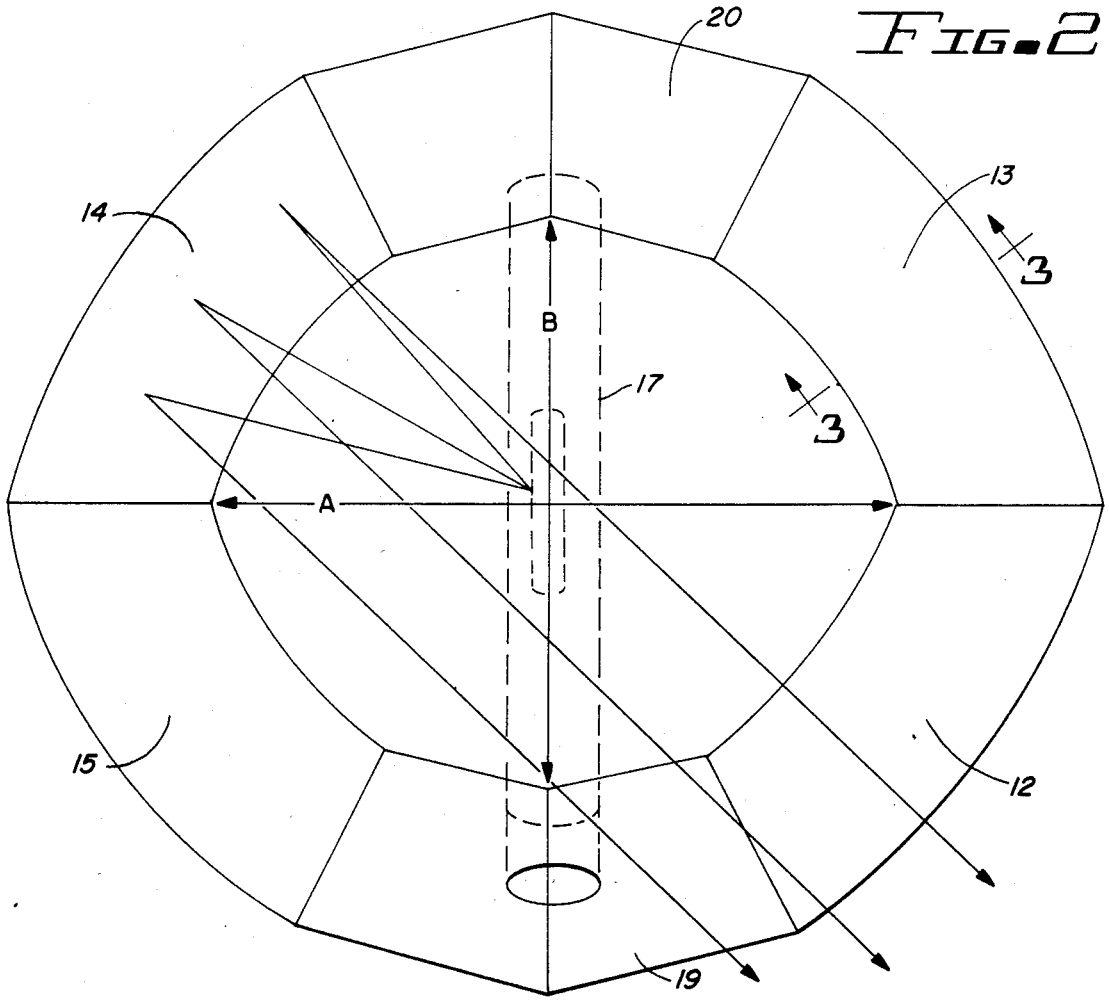
FIG. 2 is a top view of a portion of the embodiment shown in FIG. 1.

To produce additional light in planes across the axis of the bulb 17 and to uniformly disperse this light, curvature is added to the reflector sections 12, 13, 14 and 15. The lowermost part of these reflector sections below the point "C" (see FIG. 3) has a relatively sharp curvature 25 which then becomes gradually greater and progresses from the point "C" on toward the open edge 26 of the reflector segment in a parabolic curved section 27. In addition, each of the segments 12, 13, 14 and 15 have a concave circular or parabolic curvature in planes which are parallel to the plane of the open side of the housing 10, and also which are parallel to the axis of the HID lamp 17 when it is mounted in the fixture, as illustrated in FIGS. 1 and 2. This causes a relatively even and square distribution of light to be directed downwardly and outwardly from the housing 10.

If all of the light from the reflector segments 12, 13, 14 and 15 were projected in the diagonal patterns illustrated in FIG. 2, only light from the HID lamp 17 itself, which is not intercepted by the reflector segments, would be produced in planes passing through the axis of the lamp 17 and across the axis of the lamp 17. In the case of planes perpendicular or across the axis of the lamp 17, sufficient light is produced from the luminaire to fill in the sides of the square distribution since high luminous intensity is developed by HID lamps in planes perpendicular to the arc tube of the lamp. The additional light required across the axis is produced by the curvature 25/27 of the reflector segments 12, 13, 14 and 15 to produce the small increase needed in the across axis total projected light.

The amount of light which can be emitted along the axis of an HID bulb 17, however, is limited in simple forms of reflectors. In addition, the amount of direct light that is emitted from an HID lamp 17 in planes parallel to or along the axis of the bulb is small. The luminaire, therefore, has the end reflecting segments 19 and 20 added to it, in order to fill in the corresponding sides of the square which lie at the ends of the bulb 17.

As shown most clearly in FIGS. 1 and 2, these two additional reflector sections 19 and 20 are positioned at the ends of the bulb 17 to intercept light rays emitted from the lamp in planes close to the along axis plane of the bulb 17 and to redirect such light along the axis. This reflected light, along with a combination of the orientation of the reflector sections 12, 13, 14 and 15 fills in the square to fill in uniform light distribution throughout the entire area of the square being illuminated by the luminaire.

Figure 3:
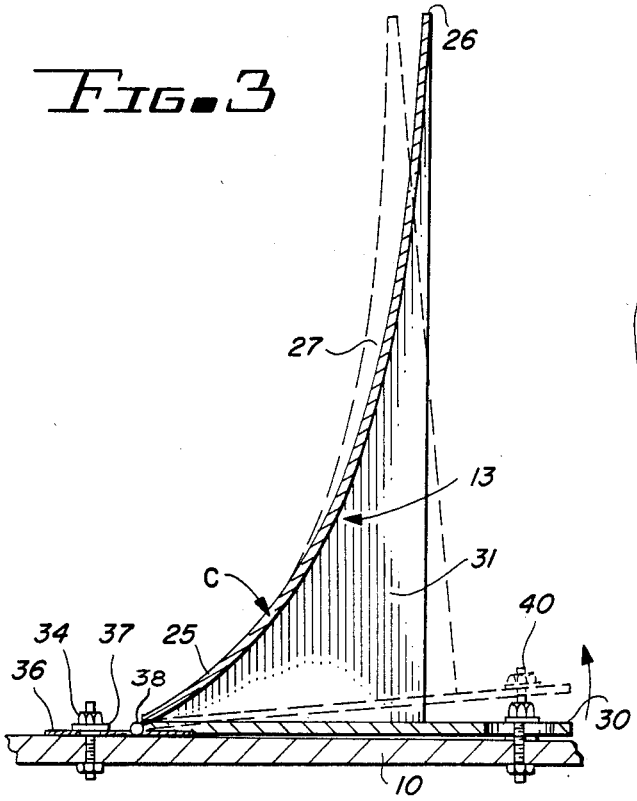
FIG. 3 is a cross-sectional view taken along the Line 3—3 of FIG. 2.

The vertical cross-sectional configuration of the end sections 19 and 20 is the same as the cross-section of the segments 12, 13, 14 and 15, which is illustrated in FIG. 3. In the horizontal intersecting planes, however, the line intersecting lines through the sections 19 and 20 are straight, without the curvature which exists in the segments 12, 13, 14 and 15. This can be ascertained from FIG. 2 by the observation of the top and bottom straight line ends of the segments 19 and 20 on both sides of the centerline crease or junction of the two portions of each of the segments 19 and 20.

It may be ascertained from an examination of FIG. 2 that the additional end reflector sections 19 and 20 could be made part of the adjacent main reflector sections 12, 13, 14 and 15 to which they are joined, if desired, rather than being made as individually added reflector components. To construct the reflector segments in this manner, all that would be necessary would be to change the curvature of the main sections 12, 13, 14 and 15 in the vicinity of the plane along the axis of the bulb 17. By constructing the reflector segments 19 and 20, however, as additional items, the curvatures in horizontal planes of the main reflector sections are uniform and smooth, such that each individual main reflector section 12, 13, 14 and 15 has its own axis of symmetry. The importance of this is that individual main sections 12 and 14 are identical to one another, as are sections 13 and 15. Sections 13 and 15 are mirror images of sections 12 and 13. By constructing each individual one of the sections 12, 13, 14 and 15 in this way, the same tool may be used to produce all four main reflector sections. This results in a substantial cost saving in the tooling for the luminaire.

Figure 4:
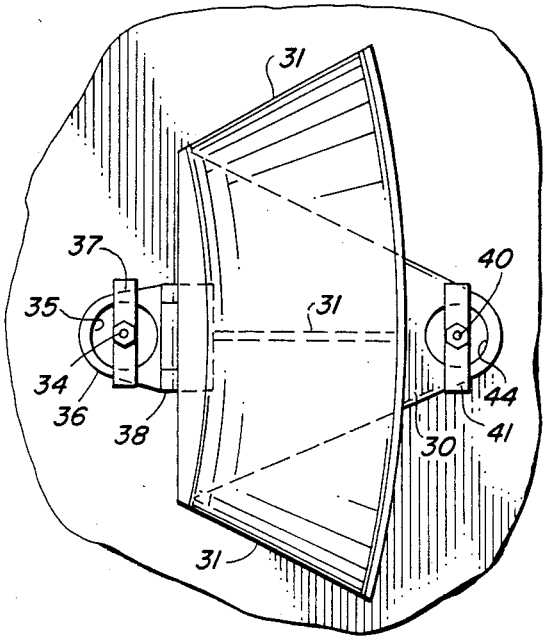
FIGS. 4 and 5 illustrate details of the structure shown in FIG. 3.

It will be recognized, particularly when viewing FIG. 3, that the main beam projected diagonally from each of the main reflector segments 12, 13, 14 and 15 may be rotated laterally by rotating the appropriate one or more of these reflector sections. Consequently, by repositioning the four reflector sections 12, 13, 14 and 15, the square pattern may be changed to a desired shape, either expanding it or contracting it, or may be changed to the shape of a rectangular pattern, if desired. To accomplish this adjustment, each of the sections 12, 13, 14 and 15 may be mounted on a sub-base of the type shown in FIGS. 3, 4 and 5. This base for each of the reflector sections 12, 13, 14 and 15 comprises a generally wedge-shaped flat-bottom member 30. This forms the bottom support for some upstanding substantially triangular support ribs 31. As shown in FIG. 4, three of these support ribs are illustrated (one at each end and one in the middle); but the number of ribs 31 may be adjusted to whatever number are necessary to adequately support the reflector sections 12, 13, 14 and 15. The support ribs 31 are connected to the reflector sections and to the base 30 in any suitable manner.

The base 30 of each of the reflector sections then is mounted onto the closed upper end of the housing 10 at two different points. One of these, illustrated most clearly in FIGS. 3 and 4, is by means of a hold-down bolt 34 passing through an enlarged hole 35 in a pivoting hinge 36. The bolt passes through the base 10 and is tightened onto a clamping bar 37 to hold the hinge 36 in the desired position, which permits turning and positioning of the reflector sections within the luminaire as established by the size of the hole 35. The hinge portion 38 of the hinge member 36 is connected to the forward or innermost edge of the reflector segment 13 (and similarly, segments 12, 13, 14 and 15).

The other end of the base 30 also is supported and held by an adjusting bolt 40, which is clamped by means of clamping bars 41 to engage an enlarged hole 44 in the right-hand end of the base 30, as shown in FIGS. 3 and 4. Adjustment of the adjusting nuts on the bolt 40 then permits the right-hand end of the reflector segment 13 (and 12, 14 and 15) to be pivoted upwardly (as shown in dotted lines in FIG. 3) to adjust the pattern produced by the luminaire.

Figure 5:
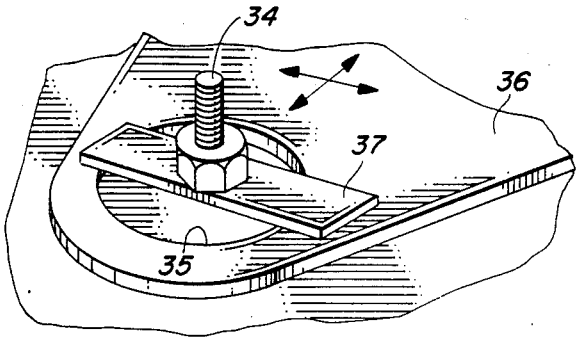

This capability of pivoting the sections 12, 13, 14 and 15, as shown in FIG. 3, facilitates in changing the vertical spread of the light rays emanating from the luminaire 10. Generally, this is accomplished by physically moving the position of the bulb 17 or lamp in a vertical plane within the luminaire. Thus, elevation of the lamp causes a depression of the reflected rays, and vice-versa. Such a technique, however, is significantly limited in the range of different spreads which may be obtained from a given luminaire. The amount of lifting of the lamp which is possible is limited by the reflector top, while the amount lowering of the lamp is limited by the location of the bottom cover glass or lower plane of the open side of the housing. To increase the range of spread possible above and beyond the range which may be obtained by alteration of the position of the bulb 17, the pivotal adjustment of the reflector segments 12, 13, 14 and 15 of FIGS. 3, 4 and 5 is provided.

It is apparent from an examination of FIG. 3 that the solid line position of the reflector segment 13 provides an elevated beam angle for the reflected rays, with a resulting increased spread of the light from the luminaire, as contrasted with the dotted line position. In addition, by adjusting the pivotal positions of the reflector segments 12 and 13 with respect to the ones on the opposite side, segments 14 and 15, it is possible to direct greater amounts of light from the fixture toward one side than are obtained from the other. This is a useful feature since, on divided highways and one-way streets and the like, it sometimes is desirable to have different projections of light toward the driver from the light projected away from the driver.

Figure 6:
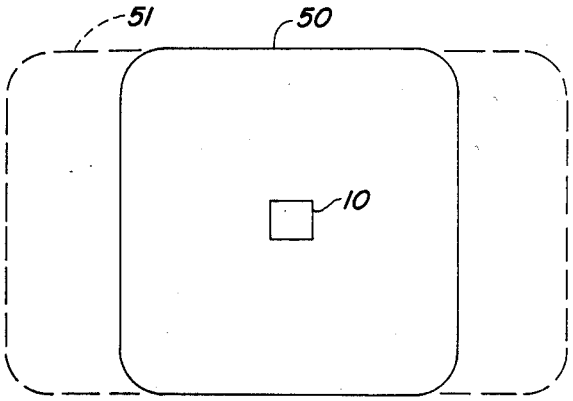
FIG. 6 illustrates a typical light pattern obtainable from the embodiment shown in FIGS. 1 and 2.

FIG. 6 illustrates a typical pattern of light from a luminaire 10 constructed in accordance with the foregoing description. The region of uniform light intensity is illustrated by the generally square area 50, shown in solid lines around the housing 10 in FIG. 6. The corners of this area are rounded somewhat because of the inherent characteristics of the luminaire formed with reflector segments in accordance with the foregoing description. Adjustment in the shape of the illuminated area can be modified to cause a rectangular pattern, such as outlined by the dotted lines 51 in FIG. 6. This may be accomplished, for example, by reducing the dimension "A" with respect to the dimension "B" shown in FIG. 2.

Figure 7:
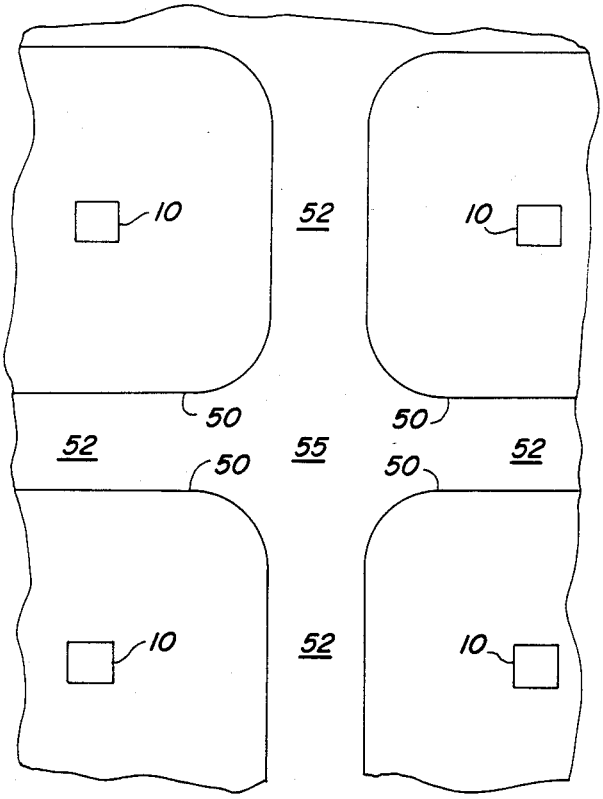
FIG. 7 illustrates a typical light distribution pattern of a plurality of fixtures of the type shown in FIG. 1.

FIG. 7 shows a typical pattern of a portion of the area illuminated by four luminaires 10 of the type shown in FIGS. 1 through 5 for a typical installation in a parking lot or the like. The regions 50 of uniform light intensity from each of the different luminaires 10 are shown in part in FIG. 7. Between each of these regions of uniform light intensity are regions of diminishing light intensity. The luminaires 10 are spaced so that the reduced light intensity along a line directly between any two luminaires outside the regions 50 overlap in regions 52 from both luminaires to produce substantially uniform illumination in the regions 52 outside of the areas 50 shown in FIG. 7.

In the center of the illuminated area in FIG. 7, which takes place at the intersection of the diagonal interconnections between each of the four luminaires 10 shown in FIG. 7, the distance from any one luminaire 10 is greater than the distance from such a luminaire to the center of the regions 52, for example. The light striking the center or intersection of the four luminaires 10 in the region 55 from each luminaire is approximately one-fourth the light which is produced by each of the individual luminaires 10 within the regions of uniform light intensity 50. Since light in the region 55 is added from all four luminaires 10, however, the the resultant light intensity in this region is substantially the same as within the regions 50. Consequently, by selecting light patterns in accordance with the layout shown in FIG. 7, a very uniform illumination of a large area may be achieved from a number of different luminaires, each producing a substantially square pattern of light.

HID lamps, such as the lamp 17, range in size from 35 watts to 1,000 watts at the present time. The physical dimensions of the various lamps of different wattages differ greatly from the smallest to the largest. It has been commonplace for luminaire manufacturers to have a range of luminaire sizes in order to handle the various lamp types and sizes. For example, the use of a luminaire sufficiently large to handle a 1,000-watt lamp would be too large to handle a small lamp, such as 35-watts. Conversely, a small luminaire sized appropriately for a small lamp, in the past has not allowed the accomodation of a large lamp. Consequently, luminaire manufacturers have typically manufactured three different sizes of luminaires, one for 250-watt lamps and smaller, one for 400-watt lamps, and one for 1,000-watt lamps. In usual forms of reflectors where a one-piece reflector is employed, each luminaire size requires a different reflector, with the reflector itself being sized appropriately for the lamp being used. This is very expensive, since three sets of reflector manufacturing tools must be constructed, and three different sets of reflector inventories must be stocked.

In the case of the invention which has been described above, however, one tool can be used to produce the reflector sections 12, 13, 14 and 15 to accomodate all sizes of HID lamps. Similarly, a single tool may be used to produce the reflector sections 19 and 20 for all sizes of lamps. A tool is made to manufacture reflector sections large enough to be utilized with a 1,000-watt lamp. For smaller sizes, a trim die may be used to reduce the size of the sections as desired. This produces great savings in manufacturing costs. Conversely, the reflector sections may be sized for the middle or 400-watt lamp, and may be used in pairs, possibly reduced in size by a trim die for a 1,000-watt lamp. Thus, the system which has been disclosed is highly versatile, in addition to the desirable features which have been described above in conjunction with the construction and operation of the system.

Various changes and modifications will occur to those skilled in the art without departing from the scope of the invention. For example, the manner of mounting the reflector segments or sections 12, 13, 14 and 15 may be accomplished in a variety of different ways other than the ones described. The particular curvatures selected also may be varied for different applications, and a variety of different reflecting materials may be used for the different reflector segments. Such changes and modifications all come within the true scope of the invention; and the embodiment which has been shown and described is to be considered as illustrative only of the invention, and not as limiting.

I claim:

1. A luminaire for use with an elongated light source which has a reduction in light intensity in the axial directions of the light source, said luminaire including in combination:

a housing having an open side for permitting light to pass outwardly therefrom; and first, second, third, and fourth reflector sections, each having continuous compound curved cross-sections in planes perpendicular to the plane of the open side of said housing, mounted in said housing for reflecting light from a bulb located therein in a plane parallel to the plane of the open side of said housing outwardly through such open side, said first and second reflector sections being located on one side of the bulb and said third and fourth reflector sections being located on the other side of the bulb to cause light from the bulb to be reflected through the open side of the said housing from each reflector section diagonally of the bulb axis.

2. The combination according to claim 1 wherein said bulb is an HID bulb.

3. The combination according to claim 1 further including means for adjusting the orientation of said first, second, third and fourth reflector sections in vertical planes to create different spreads of light.

4. The combination according to claim 3 further including means for adjusting the orientation of said first, second, third and fourth reflector sections in horizontal planes to create different patterns of light from said luminaire.

5. The combination according to claim 1 wherein one of the ends of said first and second reflector sections are joined together at a first junction, and one of the ends of said third and fourth reflector sections are joined together at a second junction, said junctions lying in a plane which is perpendicular to and transverse to the axis of the bulb, with the other ends of said first and third reflector sections extending toward one another, adjacent one end of the bulb, and the other ends of said second and fourth reflector sections extending toward one another adjacent the other end of the bulb.

6. The combination according to claim 5 further including a fifth reflector section interconnecting said other ends of said first and third reflector sections, and a sixth reflector section interconnecting said other ends of said second and fourth reflector sections to build up the light projected from said luminaire in directions along the axis of the bulb.

7. The combination according to claim 6 wherein said first, second, third and fourth reflector sections are identical in shape.

8. The combination according to claim 7 wherein a cross-section of said first, second, third and fourth reflector sections in planes perpendicular to the open side of said housing and perpendicular to the surface of said sections is a compound curve, the radius of curvature of which increases from a minimum amount within the housing to a maximum radius adjacent the open side of said housing.

9. The combination according to claim 8 wherein section lines through said first, second, third and fourth reflector sections in planes parallel to the plane of the open side of said housing comprise uniform curves for each of said reflector sections for causing a major projection of light diagonally in a horizontal plane outwardly through the open side of said luminaire.

10. The combination according to claim 9 further including means for adjusting the orientation of said first, second, third and fourth reflector sections in vertical planes to create different spreads of light.

11. The combination according to claim 10 further including means for adjusting the orientation of said first, second, third and fourth reflector sections in horizontal planes to create different patterns of light from said luminaire.

12. The combination according to claim 1 wherein said first, second, third and fourth reflector sections are identical in shape.

13. The combination according to claim 12 wherein said bulb is an HID bulb.

14. The combination according to claim 1 further including means for adjusting the orientation of said first, second, third and fourth reflector sections in horizontal planes to create different patterns of light from said luminaire.

* * * * *